US005583618A

United States Patent [19]

Takeuchi et al.

[11] Patent Number: 5,583,618

[45] Date of Patent: Dec. 10, 1996

[54] PROCESS CARTRIDGE AND IMAGE GENERATING APPARATUS

[75] Inventors: Keizou Takeuchi, Hirakata; Noboru Katakabe, Uji; Kouzou Ezawa, Katano; Shouji Nishitani, Nara; Manabu Kitajima, Osaka; Hiroshi Yasumoto, Katano, all of Japan

[73] Assignee: Matsushita Electric Industrial Co., Ltd., Osaka, Japan

[21] Appl. No.: 456,030

[22] Filed: May 31, 1995

[30] Foreign Application Priority Data

May 31, 1994 [JP] Japan ..... 6-117749
May 31, 1994 [JP] Japan ..... 6-118378
May 31, 1994 [JP] Japan ..... 6-118379

[51] Int. Cl.[6] ..... G03G 15/00

[52] U.S. Cl. ..... 355/210; 355/200

[58] Field of Search ..... 355/200, 210, 355/211, 296

[56] References Cited

U.S. PATENT DOCUMENTS 4,556,308 12/1985 Hoppner et al. ..... 355/200
4,987,446 1/1991 Mochimaru et al. ..... 355/200
5,099,280 3/1992 Takemoto et al. ..... 355/210
5,221,943 6/1993 Hasegawa ..... 355/210 X
5,249,026 9/1993 Kojima ..... 355/210 X
5,266,999 11/1993 Yashiro ..... 355/211
5,461,464 10/1995 Swain ..... 355/211

*Primary Examiner*—Arthur T. Grimley
*Assistant Examiner*—Sophia S. Chen
*Attorney, Agent, or Firm*—Ratner & Prestia

[57] ABSTRACT

The present invention provides a process cartridge having components which are easy to assemble and disassemble and are convenient to reuse. A process cartridge of the present invention comprises a first unit having a photosensitive drum; a second unit having a cleaning means for the photosensitive drum; and wherein the first unit and the second unit are rotatably hinged to each other by a coupling shaft projecting from the side wall of the first unit and a coupling hole perforating the side wall of the second unit. The second unit is fixed at a position where the hinged rotation of the second unit in a predetermined direction with respect to the first unit is stopped.

17 Claims, 9 Drawing Sheets

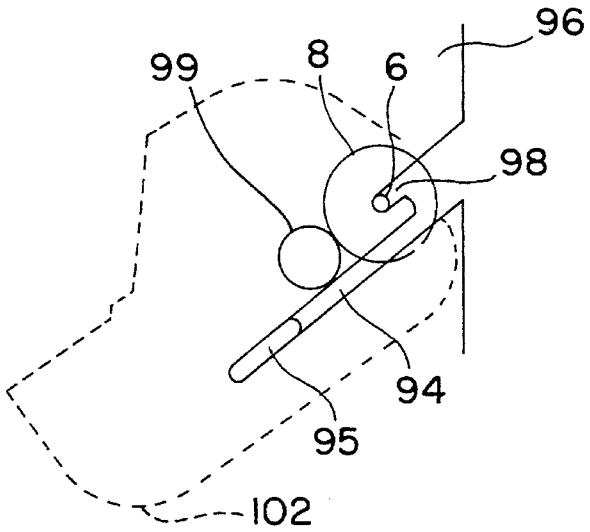
FIG. 13
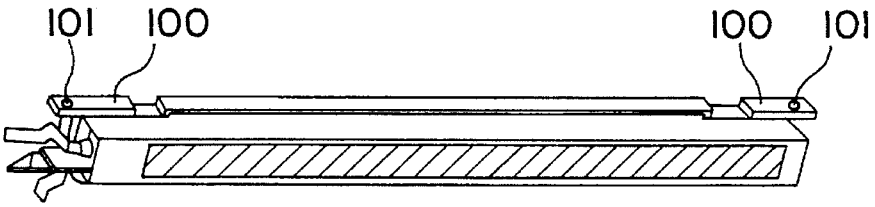
FIG. 14
FIG. 15(a)
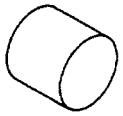
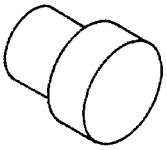
FIG. 15(b)
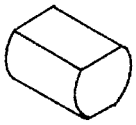
FIG. 15(c)
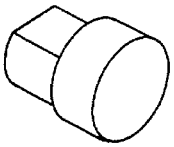
FIG. 15(d)

PROCESS CARTRIDGE AND IMAGE GENERATING APPARATUS

FIELD OF THE INVENTION

The present invention relates to a process cartridge used in an apparatus for image generating by electro-photographic processes, such as copy machines, facsimiles, and laser beam printers, and an image generating apparatus using this process cartridge.

BACKGROUND OF THE INVENTION

Electro-photographic processes comprising a plurality of process means require more maintenance as compared with thermosensitive processes or ink-jet processes. By integrally assembling a process cartridge with a plurality of the process devices such as a photosensitive drum, a charger, a toner case, and a cleaner, the maintenance may be reduced. But, usage of conventional process cartridges make the cost of copying expensive since the process cartridge must be replaced when toner is used up. The present invention provides a reusable process cartridge which facilitates lowering the cost of copying.

SUMMARY OF THE INVENTION

The process cartridge which has been depleted of toner may be readied for reuse by disassembling, cleaning, reassembling, and then supplying the process cartridge with new toner. The process cartridge of the present invention has components which may be easily assembled and disassembled for convenient reuse. The process cartridge of the present invention is designed to prevent the photosensitive drum from being damaged and to prevent the toner from spilling from the cartridge when it is assembled or disassembled.

A process cartridge of the present invention comprises:

a first unit having a photosensitive drum; and a second unit having a means for cleaning the photosensitive drum. The first and second units are rotatably hinged to each other by a coupling shaft projecting from the side wall of the first unit and a coupling hole perforating the side wall of the second unit. The second unit is fixed at a position where hinged rotation of the second unit in a predetermined direction with respect to the first unit is prevented.

The coupling shaft has at least one cut portion, wherein the coupling shaft diameter is a minimum at the cut portion. The coupling hole has an opening where the width of the opening is smaller than the diameter of the coupling shaft and slightly larger than the width of the cut portion. As a result, the first and second units can be rotatably hinged when approaching each other only along a specific relative angle whereby the cut portion of the coupling shaft passes through the opening of the coupling hole. That is, the first and second units can be assembled or disassembled only along relative angle determined by the cut portion of the coupling shaft.

Thereby, the photosensitive drum is prevented from being damaged when assembled and disassembled, because the cut portion of the coupling shaft is designed so that the front edge of the cleaning means does not damage the photosensitive drum when the front edge of the cleaning means contacts or moves away from the photosensitive drum along the specific relative angle. When the first unit and the second unit are hinged, the used toner case provided in the second unit is sealed by the photosensitive drum and the cleaning blade. Thereby the used toner is prevented from spilling when the second unit is rotated around the first unit.

BRIEF DESCRIPTION OF THE DRAWINGS

FIG. 13 shows a process cartridge of the present invention within an image generating apparatus.

FIG. 14 is a perspective view showing an alternative charger.

FIG. 15 shows several alternative coupling shafts.

EXEMPLARY EMBODIMENTS

Figure 1:
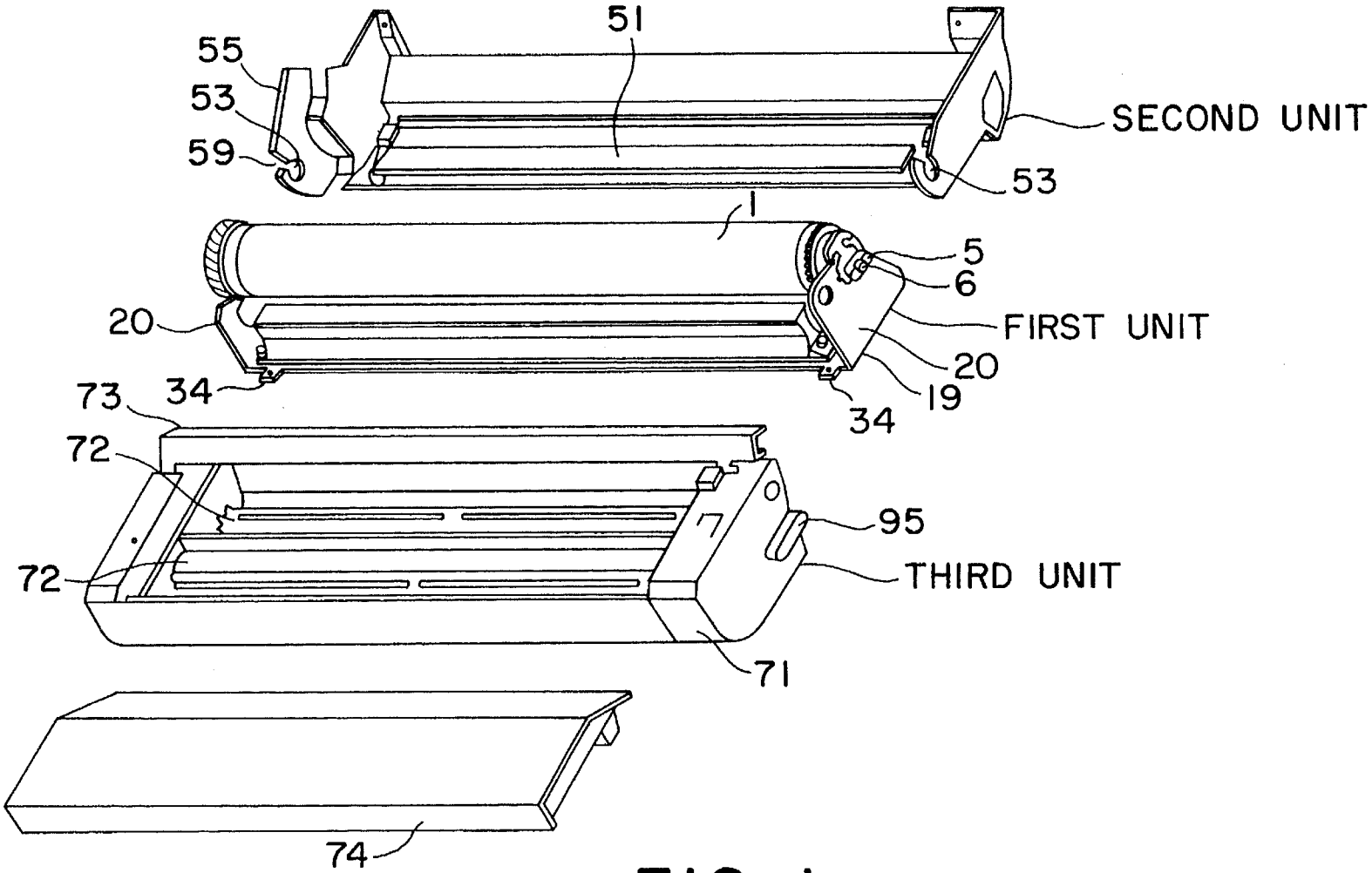
FIG. 1 is a perspective view of the parts of a process cartridge of the present invention prior to assembly.
Figure 2:
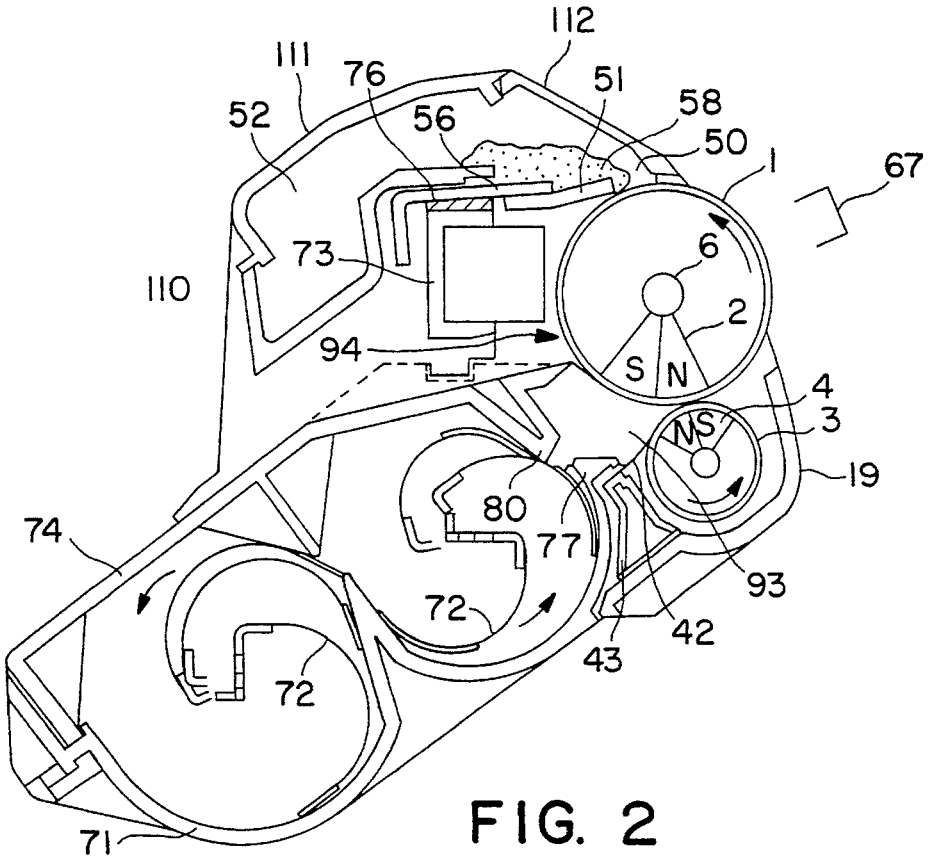
FIG. 2 is a sectional view of the process cartridge of the present invention.

The process cartridge shown in FIGS. 1 and 2 comprises three units. The first unit has photosensitive drum 1 which is rotatable around support shaft 6, and electrode roller 3 which is used for development. The second unit has a cleaning blade 51 for cleaning photosensitive drum 1 and used toner case 52 for accommodating used toner scraped from photosensitive drum 1. The third unit has charger 73 for charging photosensitive drum 1, toner case 71, and cover 74.

(1) Composition of the First Unit

Figure 3:
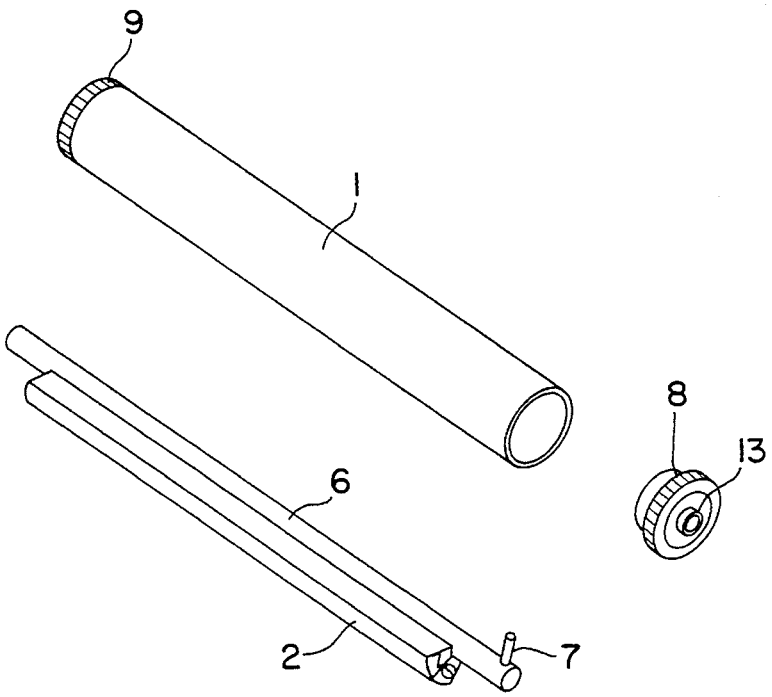
FIG. 3 shows the components of a photosensitive drum.
Figure 5:
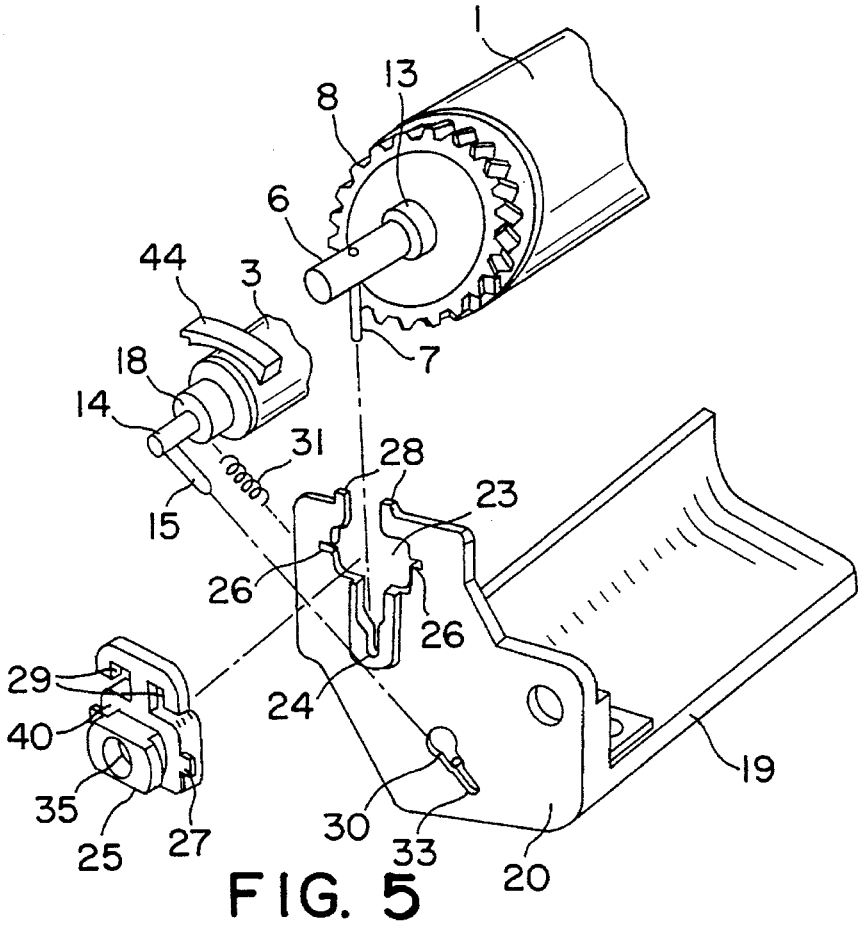
FIG. 5 illustrates the components of a first unit.

Photosensitive drum 1 comprises an aluminum tube, for example a 30 mm. in diameter, and photosensitive material such as a phthalocyanine system painted on it. As shown in FIGS. 3 and 5, permanent semicircular magnet 2 is fixed on support shaft 6. Photosensitive drum 1 is rotatably supported on support shaft 6 by penetrating bearing parts 13 of gears 8 and 9 at both ends of photosensitive drum 1. As permanent magnet 2 is provided within photosensitive drum 1, it cannot be seen in the assembled state of photosensitive drum 1 as shown in FIG. 5. But, pin 7 fixed at the end of support shaft 6 indicates the position of permanent magnet 2. Accordingly permanent magnet 2 is fixed at the correct position by fixing pin 7 at a predetermined position.

Figure 4:
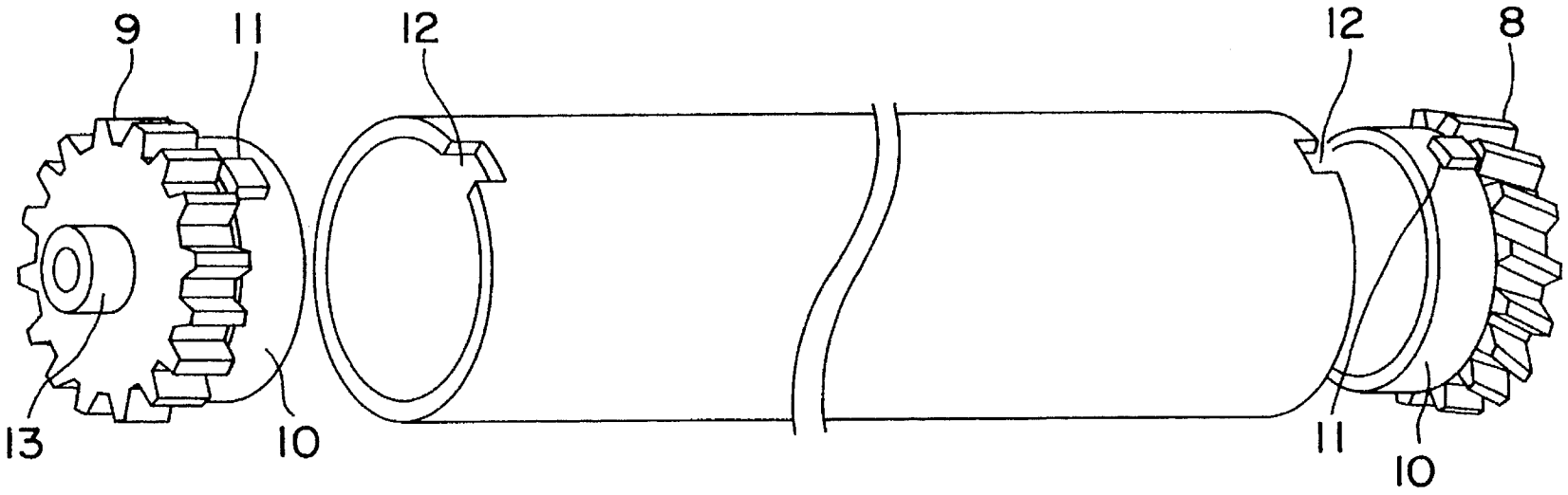
FIG. 4 shows a gear assembly of the photosensitive drum.

As shown in FIG. 4, helical gear 8 having 32 teeth and a module of 0.9, is fixed at the one end of photosensitive drum 1 and spur gear 9 having 32 teeth and a module of 0.8 is fixed at other end of the photosensitive drum 1. Gears 8 and 9 having cylindrical parts 10 are connected to the inside diameter of photosensitive drum 1, and each projection 11 is fitted into each notch 12. Thereby, gears 8 and 9 are fixed at both ends of photosensitive drum 1 at the relative positions and may be shifted by as much as 0.5 teeth. For easy machining, notches 12 are preferably linearly aligned at both ends of photosensitive drum 1. In this case, the angles of projections 11 with respect to the teeth of gears 8 and 9 may differ by as much as 0.5 teeth. When the process cartridge is assembled in an image generating apparatus, the torque for rotating photosensitive drum 1 and the torque for rotating electrode roller 3, toner supply feathers 72, and gear 9 are transmitted from a driving gear (not shown) which is connected to gear 8.

Figure 11:
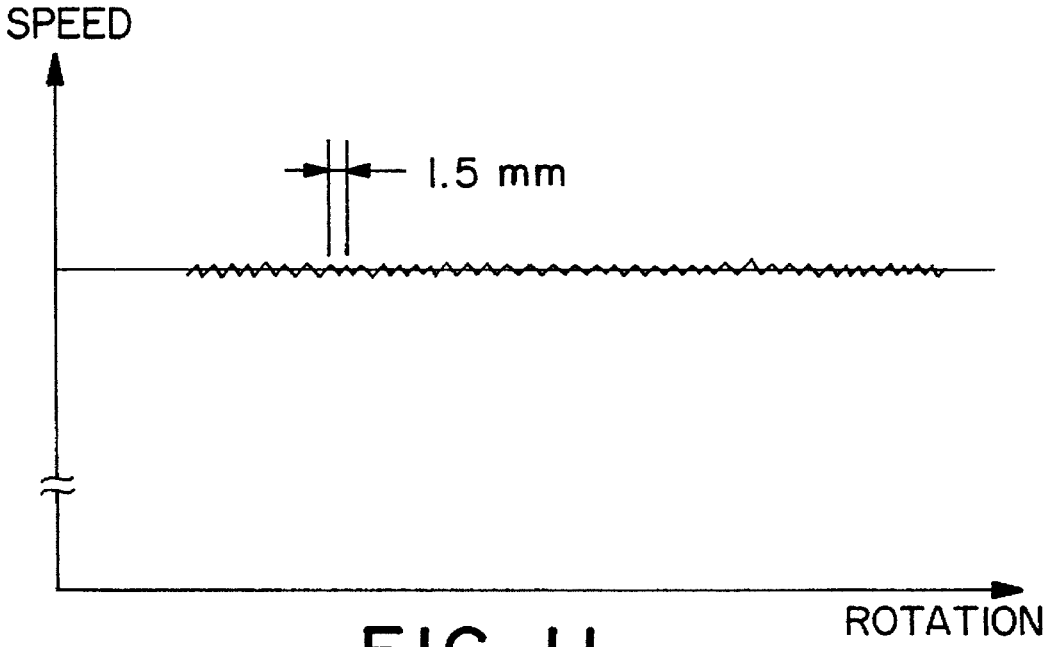
FIG. 11 shows speed fluctuation of the photosensitive drum when the phase difference between the gears at both ends of the photosensitive drum is 0.5 tooth pitch.
Figure 12:
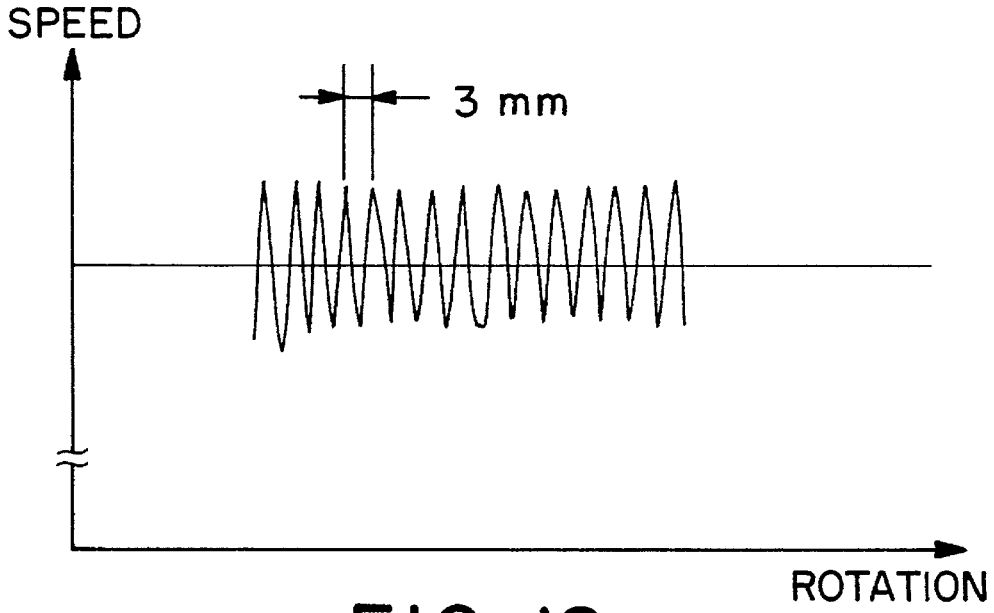
FIG. 12 shows speed fluctuation of the photosensitive drum when the phase difference between the gears at both ends of the photosensitive drum is 0.

As the torque transmitted by gear 8 is relatively large, wow and flutter will likely cause disturbance of the image. By analyzing the image disturbance, it was seen that a flutter of 32 (the same number as the number of teeth) cycles per rotation of photographic drum 1 was generated. That is, fluctuation of the gear load caused flutter of photosensitive drum 1. In the present invention, as described above, gear 8 and gear 9 are shifted by as much as 0.5 teeth, so that the fluctuation of gear loads of gears 8 and 9 cancel each other, and jitter on the image does not appear. This effect is shown in FIGS. 11 and 12. The flutter of photosensitive drum 1 is shown in FIG. 11. Small flutter of 1.5 mm pitch (equivalent to a gear having 64 teeth), was seen, but the jitter on the image was too small to be seen. FIG. 12 shows the flutter of photosensitive drum 1 when gears 8 and 9 have no positional shift. Flutter of about 3 mm pitch (equivalent to a gear of 32 teeth) was seen. The obvious jitter on the image was observed.

The composition of electrode roller 3 is shown in FIGS. 2 and 5. Electrode roller 3 comprises a 16 mm diameter stainless steel tube and semicircular permanent magnet 4 which is fixed on support shaft 14 in the same manner as in photosensitive drum 1. Electrode roller 3 is rotatably supported on support shaft 14 by support bearing parts 18 at both ends. As permanent magnet 4 is provided within electrode roller 3, it cannot be seen in FIG. 5. But, pin 15 fixed at the end part of support shaft 14 indicates the position of permanent magnet 4. Accordingly, permanent magnet 4 is positioned by fixing pin 15 at a predetermined location.

The first unit, as shown in FIG. 5, comprises frame 19, photosensitive drum 1, and electrode roller 3. FIG. 5 shows half of the first unit. The other half of the first unit has the same components and is assembled in the same manner. The assembly of the first unit includes the following steps.

(Step 1) Spring 31 is inserted in groove 26 in side wall 20 of frame 19. Electrode roller 3 is attached to frame 19 by inserting support shaft 14 into hole 30 so that pin 15 is fitted into groove 33. Since the position of pin 15 is fixed, permanent magnet 4 is fixed at the predetermined position shown in FIG. 2. Spacer 44 is placed on electrode roller 3 to maintain a space between photosensitive drum 1 and electrode roller 3. One end of spacer 44 is held by frame 19 and the other end is free. Spring 31 urges electrode roller 3 toward photosensitive drum 1.

(Step 2) Support shaft 6 is inserted into cut portion 23 so that pin 7 fits into groove 24 to attach photosensitive drum 1 to frame 19. Since the position of pin 7 is fixed, permanent magnet 2 is set at the predetermined position shown in FIG. 2.

(Step 3) After placing support shaft 6 of photosensitive drum 1 slidably through hole 35, support means 25 for supporting the photosensitive drum 1 is inserted in cut portion 23 of frame 19 so that surface 40 coincides with the outer surface of side wall 20. The external shape of support means 25 is inserted into cut portion 23. Projection 27 and grooves 29 of support means 25 are inserted into groove 26 and projections 28 of frame 19, respectively. Grooves 29 prevents the space between projections 28 from incorrectly enlarging, and accordingly, tightly holds support means 25 in cut portion 23. Thereby, photosensitive drum 1 is set into frame 19. Electrode roller 3 pushes photosensitive drum 1 by the force of spring 31. Spacer 44 fits between electrode roller 3 and photosensitive drum 1. Support means 25 has coupling shaft 5 used for coupling the first unit and the second unit. Coupling shaft 5 is integrally assembled with support means 25 in one body. Support shaft 6 is inserted into hole 35 of coupling shaft 5. The inner diameter of hole 35 is adapted to fit support shaft 6 in the portion close to photosensitive drum 1. Hole 35 is a little larger in the portion away from photosensitive drum 1. In this way, support shaft 6 may be prevented from bending even if support shaft 6 is forced when support means 25 is inserted into hole 35.

(Step 4) As shown in FIG. 2, scraper base 43 having scraper 42 made of phosphor bronze plate of 0.18 mm thickness is fixed at the bottom of frame 19. The front edge of scraper 42 contacts the surface of electrode roller 3 to scrape toner from electrode roller 3.

(2) Composition of the Second Unit

The second unit, as shown in FIGS. 1 and 2, is composed of cleaning blade 51 and used toner case 52. The assembly of the second unit includes the following steps.

(Step 1) Metal plate 56 having cleaning blade 51 is fixed on frame element 110. When assembled with the first unit as described later, the front edge of cleaning blade 51 contacts the surface of photosensitive drum 1 to scrape the toner from on photosensitive drum 1.

(Step 2) Elastic material 76 urges charger 73 downward and is fixed to metal plate 56.

(Step 3) Used toner case 52 holds used toner 58, which is scraped by cleaning blade 51, and is defined by frame elements 110, 111, and 112. Used toner 58 passes through used toner inlet 50, flows over cleaning blade 51, and enters used toner case 52.

(3) Composition of the Third Unit

The third unit, as shown in FIGS. 1 and 2, is composed of charger 73, toner supply blades 72, toner case 71, and cover 74. The assembly of the third unit includes following steps.

(Step 1) Toner supply blades 72 are fixed in toner case 71.

(Step 2) The toner case 71 is covered with cover 74.

(Step 3) The opening defined by edge 77 of toner case 71 and edge 80 of cover 74 is sealed and then toner case 71 is filled with toner through a toner supply hole (not shown) provided in toner case 71. Toner is a high resistance magnetic material including a polystylene system resin (100 wt. ratio), magnetic powder (80 wt. ratio), and a negative electric charge controller (3 wt. ratio).

Figure 7:
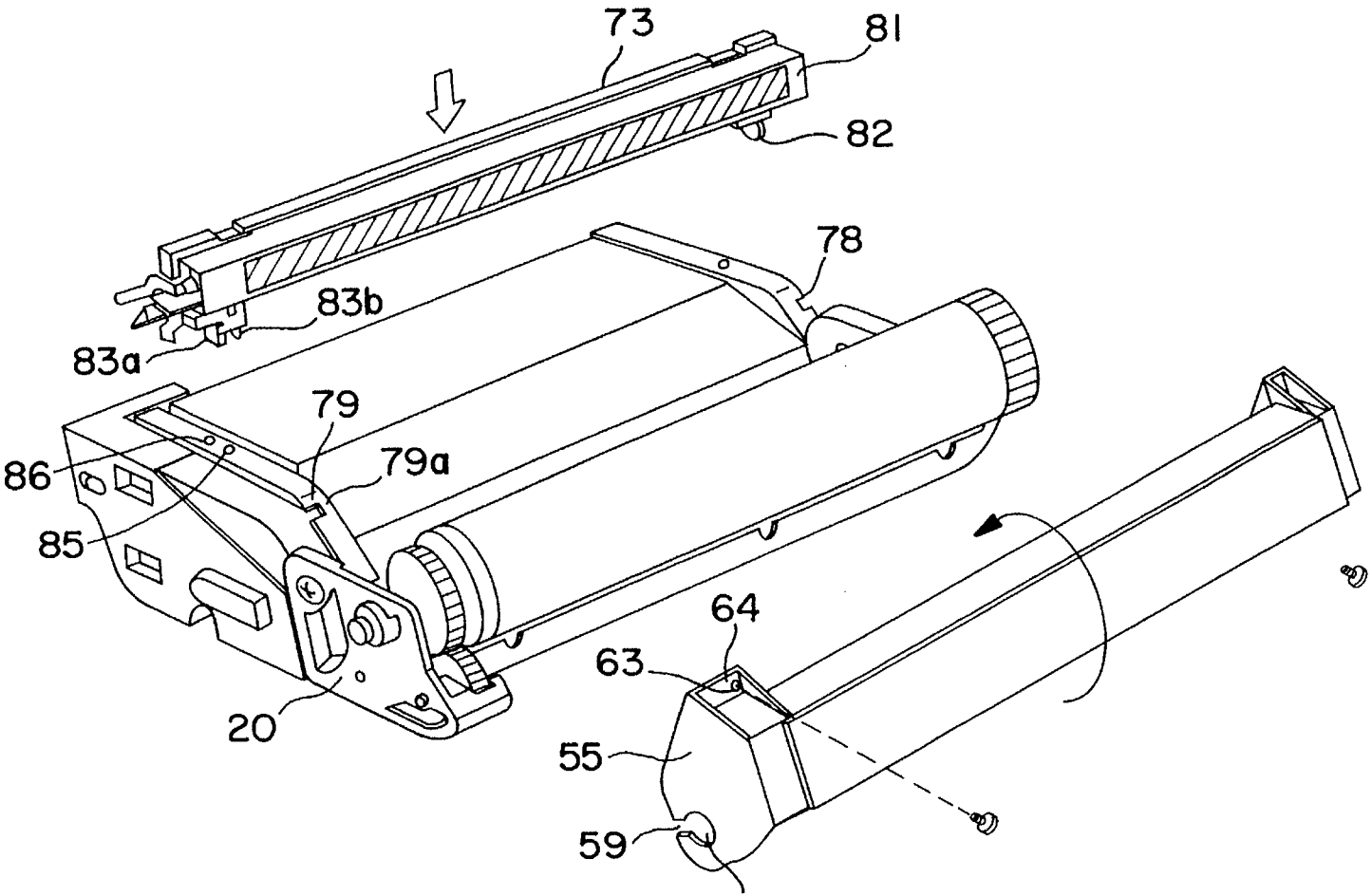
FIG. 7 illustrates assembly of the second unit.

(Step 4) As shown in FIG. 7, after combining the first unit and the third unit, charger 73 having grid electrode 81 is attached to the third unit. The distance between projections 82 and **83*b* of charger 73 is equal to the distance between grooves 78 and 79 provided on the side frame of the third unit. By inserting projections 82 and 83*b* into grooves 78 and 79, the charger is positioned against the photographic drum 1. Also, the distance between projections 83*a* and 83*b* is equal to side frame width 79*a*. The projections 83*a*** and 83*b* accommodate side frame width 79*a* tightly so that charger 73 is securely fixed to the third unit. FIG. 14 is a charger having an alternate construction where charger 73 is fixed to the third unit by screws through holes 101 in holder plate 100.

The three units are fixed to each other by, first, fixing the first unit and the third unit to each other, and then fixing the first unit and the second unit to each other.

The first unit and the third unit are fixed to each other by aligning holes 34 of the first unit shown in FIG. 1 with the holes of the third unit (not shown). The first and third units are then secured together with screws or nuts and bolts.

Figure 6:
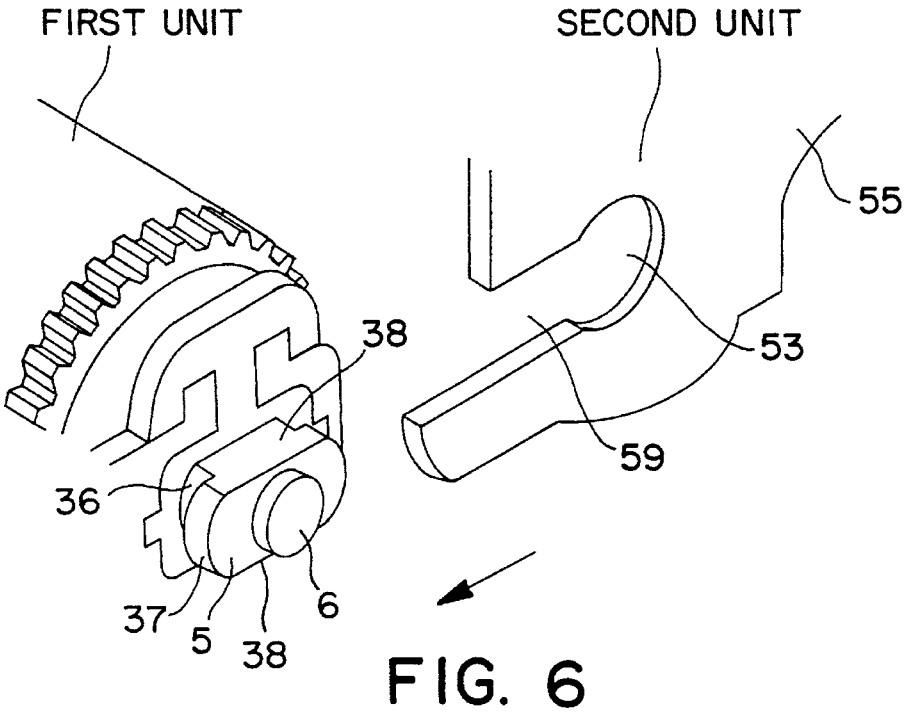
FIG. 6 illustrates the hinge coupling of a coupling shaft of the first unit and coupling hole of a second unit.

Fixing the first unit and the second unit is illustrated in FIGS. 6 and 7. In FIG. 7, the first unit and the third unit are already fixed. After that, the second unit is fixed to the first unit. As shown in FIG. 7, opening 59 and coupling hole 53 are provided at side wall 55 of the second unit. Coupling shaft 5 projects from side wall 20 of the first unit. Wall 55, opening 59, connecting hole 53, side wall 20, and coupling shaft 5 as shown in FIG. 7, of course, exist at both ends of the first and second units. The first and the second units are rotatably hinged by inserting coupling shaft 5 into coupling hole 53. FIG. 6 shows the detail of coupling hole 53 and coupling shaft 5.

As shown in FIG. 6, coupling hole 53 has opening 59 towards the outside and coupling shaft 5 has two parallel D cuts 38. The width across coupling shaft 5 is minimum at the D cuts, and the width of the opening 59 is slightly larger than that of the D cuts. Coupling shaft 5 fits within the opening at D cuts 38, and can enter opening 59 only along a predetermined relative angle with respect to the opening. As the width of coupling shaft 5 is larger than that of opening 59 (except at the predetermined relative angle), coupling shaft 5 cannot pass through opening 59. Accordingly, the first unit and the second unit can be assembled and disassembled only along said predetermined relative angle. In FIG. 6, when the second unit is moved in the direction of the arrow along the predetermined relative angle, opening 59 accommodates coupling shaft 5 at D cuts 38, and cylinder part, 36 fits into coupling hole 53. In this way, the first unit and the second unit are rotatably hinged whereby coupling shaft 5 is a fulcrum. Cylinder part 36 of coupling shaft 5 is usually coaxial with support shaft 6.

Figure 8:
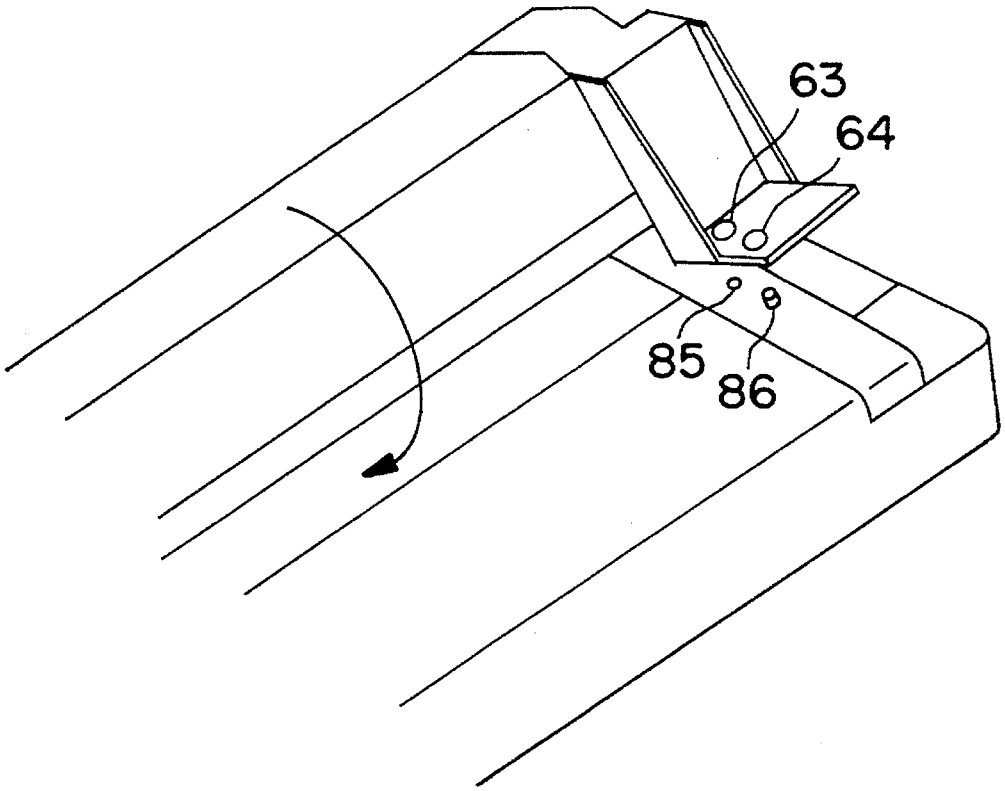
FIG. 8 illustrates the rotation of the second unit to align the second unit with the third unit during assembly and disassembly.

Next, the second unit is rotated around coupling shaft 5 with coupling shaft 5 as the fulcrum as shown by the arrow in FIG. 7 and 8. The second unit is stopped at the end of rotation of the hinge by contacting the third unit.

Figure 9:
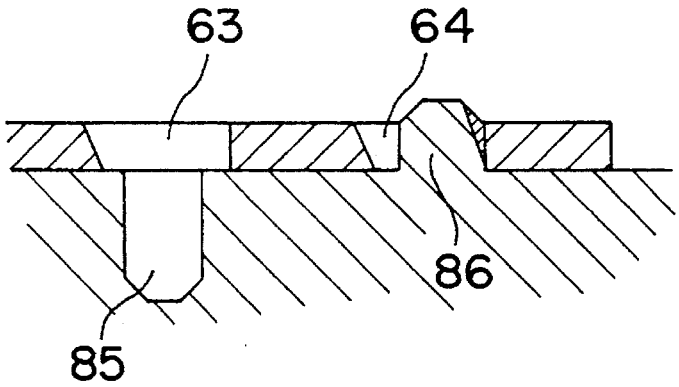
FIG. 9 illustrates the positioning and alignment between the second unit and the third unit.

As shown in FIG. 2, cleaning blade 51 is set at correct objective position at the end of rotation end of the hinge. Also, the second unit urges charger 73 to the third unit with elastic material 76 at the end of rotation of the hinge. In this way, charger 73 is securely fixed. As shown in FIGS. 8 and 9, the second unit is set at a relative position with respect to the third unit by positioning means consisting of hole 64 on the second unit and projection 86 located at the rotating end of the hinge of the third unit. The second unit is secured to the third unit by a clamping or fixing means, e.g., a screw or a nut and bolt (not shown) through holes 63 and 85. Of course, it is possible to fix the second unit to the first unit at the rotation end of the hinge by other means. As described above, the second unit approaches the first unit along a predetermined relative angle by which opening 59 can pass D cuts 38, and become rotatably hinged with the first unit with coupling shaft 5 as the fulcrum. In this way, photosensitive drum 1 is prevented from being damaged by the front edge of the cleaning blade 51 during assembly and disassembly. Because the position of D cuts 38 of coupling shaft 5 is selected so that tile edge of the cleaning blade 51 does not damage photosensitive drum 1 when cleaning blade 51 moves along the predetermined relative angle, the position of D cuts 38 may be selected to allow cleaning blade 51 to remain in contact with or be separated from photosensitive drum 1. When the first unit and the second unit are hinged, the front edge of cleaning blade 51 contacts photosensitive drum 1 so that used toner inlet 50 is closed off by photosensitive drum 1, the front edge of cleaning blade 51, and frame element 112. Thereby, when the hinged second unit is rotated around the first unit, used toner 58 can be prevented from spilling. When coupling shaft 5 has no D cut, the width of the opening of coupling hole 53 is naturally larger than the diameter of tile coupling shaft. Accordingly, the first unit and the second unit can be hinged at any relative angle. But in this case, one must be careful so as not to damage photosensitive drum 1 by hitting it with the front edge of cleaning blade 51. FIGS. 15*a*–15*d* show several kinds of coupling shafts.

As shown in FIG. 6, end plate 37 of coupling shaft 5 has larger dimensions than cylinder part 36 which supports side wall 55 of the second unit. But, where the same effect can be given to the second unit by surface 40 of support block 25, FIG. 5, end plate 37 is not necessary.

Figure 10:
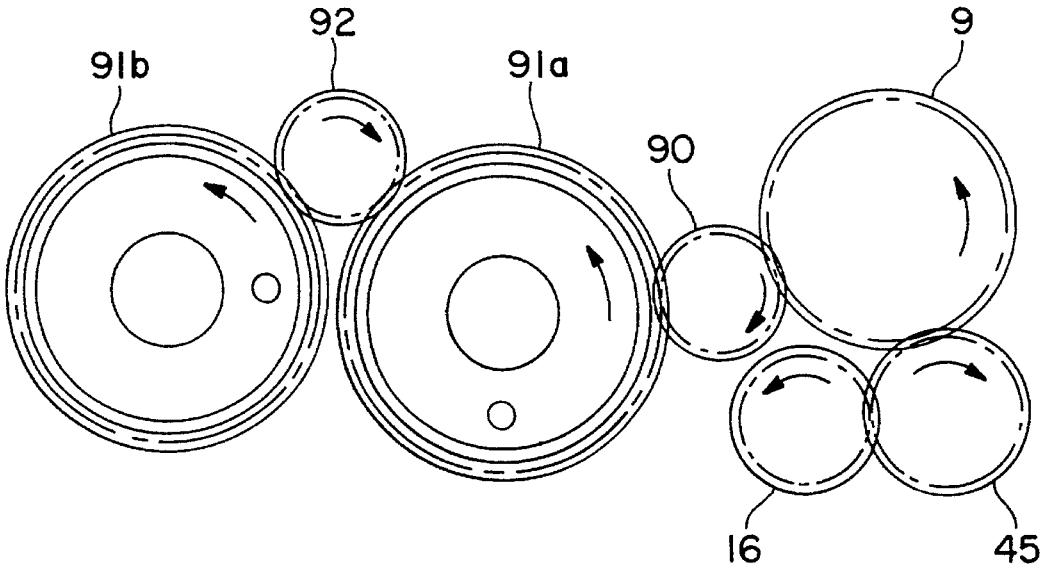
FIG. 10 shows a gear train of the process cartridge of the present invention.

FIG. 10 shows a gear train for driving the process cartridge. Torque for driving the process cartridge is provided to gear 8 (not shown) at one end of the photosensitive drum 1. Gear 9 at the other end of photosensitive drum 1 transmits the torque to other parts. Gear 9 rotates counter-clockwise, and engages intermediate gears 45 and 90. Intermediate gear 45 engages gear 16 fixed to electrode roller 3 (not shown) and electrode roller 3 rotates counter-clockwise. Intermediate gear 90 rotates gear 91*a* counter-clockwise. Gear 91*a* is fixed to one of the toner supply blades (not shown). Rotation of gear 91*a* is transmitted to 91*b* through intermediate gear 92 to rotate gear 91*b* counterclockwise. Gear 91*b* is fixed to the other toner supply feather (not shown).

FIG. 13 shows process cartridge 102 assembled with main body 96 of an image generating apparatus. Support shaft 6 of photosensitive drum 1 is coupled to groove 98, and projection 95 (FIG. 2) on the side wall (not shown) of the third unit is coupled to groove 97. Torque for driving process cartridge 102 is provided by gear 99 to gear 8. Also, process cartridge 102 and main body 96 of the image generating apparatus are electrically connected (not shown).

Image generation of the image generating apparatus is described with reference to FIG. 2. In FIG. 2, toner supply blade 72 is rotated by turning the power switch to on, and toner is supplied to toner supply portion 93 from the opening defined by edges 77 and 80. Toner is supplied to toner supply portion 93 by the magnetic field provided by magnets 2 and 4 as shown. Photosensitive drum 1 is charged to 500 V when passed at a speed of 32.5 mm per second near charger 73. Laser beam 94 is irradiated and an electrostatic latent image is formed on photosensitive drum 1. When the electrostatic latent image is passed through toner supply portion 93 as it rotates, toner is attached all over the surface of photosensitive drum 1. Then, the electrostatic latent image is passed in front of electrode roller 3. AC voltage of peak to peak 1.6 KV (3 kHz) superposed with DC voltage of 300 V is applied to electrode roller 3. When the electrostatic latent image faces electrode roller 3, all of toner except that which adheres to the electrostatic latent image is collected by electrode roller 3. Accordingly, the toner image made by toner on the electrostatic latent image is formed after the electrostatic latent image passes by electrode roller 3. The toner image is imprinted on a paper (not shown) by imprinter 67.

Imprinted paper is ejected out of the main body through a fuser (not shown). Residual toner on photosensitive drum 1 is removed by cleaning blade 51. The residual toner is then passed through used toner inlet 50 and received by used toner case 52. Residual toner on electrode roller 3 is scraped by scraper 42 and returned to toner supply portion 93. By the processes described above, toner in toner case 71 is consumed. The quantity of the toner in toner case 71 is detected by a detecting means (not shown). When the supply of toner in the toner case 71 is depleted, this used process cartridge is removed.

The removed cartridge is disassembled and equipped for reuse. The second unit is rotated in the counter direction to the arrow in FIG. 8 after the second unit is released from the third unit. And, the second unit is removed from the first unit along the predetermined relative angle where opening 59 of coupling hole 53 can pass along D cuts 38 of coupling shaft 5. As described above, while the second unit is rotated in the counter direction to the arrow in FIG. 8, used toner inlet 50 is closed off by photosensitive drum 1, the front edge of cleaning blade 51, and frame element 112. Accordingly, the used toner is prevented from spilling out. Also, since used toner inlet 50 faces upward at a predetermined relative angle, the used toner does rot spill out when the second unit is removed from the first unit. Used toner 58 in the second unit and the residual toner in the first unit are cleaned out by absorption.

At the same time, charger 73, photosensitive drum 1, electrode roller 3, and all other members are cleaned and then reassembled. Also, toner case 71 is filled with new toner through a toner filling hole (not shown) and preparation of the process cartridge for reuse is finished.

The invention may be embodied in other specific forms without departing from the spirit or essential characteristics thereof. The present embodiment is, therefore, to be considered ill all respects as illustrative and not restrictive. The scope of the invention is indicated in the appended claims rather than by the foregoing description and all changes which come within the meaning and range of equivalency of the claims are therefore intended to be embraced therein.

What is claimed:

1. A process cartridge for use in an image copy machine comprising:

a first unit rotatably supporting a photosensitive drum having two ends;

a second unit having a cleaning means for cleaning said photosensitive drum and a coupling means for coupling said first unit and second unit;

wherein, said first and second units are rotatably hinged to each other concentrically with a rotational axis of said photosensitive drum by said coupling means.

2. The process cartridge of claim 1, said first unit further comprising a side wall facing each end of the photosensitive drum;

said second unit further comprising a side wall facing each side wall of the first unit;

wherein said coupling means further comprising first elements and second elements, said first elements mounted on said side walls of the first unit concentrically with the rotational axis of the photosensitive drum, said second elements mounted on said side walls of the second unit;

wherein said first and second units are rotatably hinged to each other concentrically with the rotational axis of the photosentive drum by coupling said first and second elements of said coupling means.

3. The process cartridge of claim 2, wherein said first element of said coupling means comprises a coupling shaft projecting from said side wall of said first unit, and wherein said second element of said coupling means comprises a coupling hole having predetermined dimensions perforating said side wall of said second unit.

4. The process cartridge of claim 3, wherein said coupling shaft comprises an end plate having dimensions which are larger than said coupling hole, and wherein said coupling hole is rotatably engaged around said coupling shaft between said side wall of said first unit and said end plate.

5. The process cartridge of claim 3, wherein said coupling shaft has a predetermined diameter and at least one cut portion having a predetermined width, and wherein said coupling shaft diameter is a minimum at said cut portion, and said coupling hole has two sides and an opening having a predetermined width toward one side of said hole, wherein the width of said opening is smaller than the diameter of said coupling shaft and larger than the width of said cut portion, wherein said first and second units are rotatably hinged to each other by parallel alignment of said second unit with said photosensitive drum whereby said second unit approaches said first unit along a specific relative angle by which said coupling hole engages said coupling shaft at said cut portion.

6. The process cartridge of claim 3, wherein said first unit further comprises means for supporting said photosensitive drum, and wherein said side wall of said first unit has a cut portion, which tightly holds said photosensitive drum support means.

7. The process cartridge of claim 6, wherein said cut portion in said side wall of said first unit has an opening having two sides and a first coupling means connected to both sides of said opening, and wherein said photosensitive drum support means has a second coupling means for coupling said photosensitive drum to said first coupling means on said first unit, and wherein the joining of said first coupling means and second coupling means prevents said opening from becoming enlarged incorrectly.

8. The process cartridge of claim 7, wherein said first coupling means comprises projections at both sides of said opening, and said second coupling means comprises grooves to accommodate said projections.

9. The process cartridge of claim 8, wherein said coupling shaft which projects from said side wall of said first unit and said support means for supporting said photosensitive drum are coaxial.

10. The process cartridge of claim 6, wherein said coupling shaft projecting from said side wall of said first unit and said support means for supporting said photosensitive drum are integrally formed into one body.

11. An image generating apparatus comprising: a process cartridge according to claim 1, including means for mounting said process cartridge to said apparatus, means for exposing a photosensitive drum in said process cartridge, and means for imprinting a toner image on said photosensitive drum.

12. The process cartridge of claim 1, wherein said first and second gears are in a 0.5 tooth pitch phase difference.

13. The process cartridge of claim 1, wherein said cleaning means comprises a cleaning blade which contacts the surface of said photosensitive drum when said first and second units are rotatably hinged to each other.

14. A process cartridge for use in an image copy machine comprising:

a first unit rotatably supporting a photosensitive drum and having a toner image developing means;

a second unit having a cleaning means for cleaning said photosensitive drum;

a third unit having a toner case, wherein said third unit is connected to said first unit;

a couplilng means for coupling said first unit and said second unit;

wherein said first and second units are rotatably hinged to each other concentrically with a rotational axis of said photosensitive drum by said coupling means.

15. The process cartridge of claim 14, wherein the rotation of the second unit fixed to the third unit with respect to said first unit is stopped by said third unit.

16. The process cartridge of claim 15, further comprising:

a means for fixing said second unit to said third unit after said second unit has been rotated in a predetermined direction with respect to said first unit.

17. The process cartridge of claim 14, wherein said third unit further comprises a charger for charging said photosensitive drum.

* * * * *

UNITED STATES PATENT AND TRADE MARK OFFICE

CERTIFICATE OF CORRECTION

PATENT NO. : 5,583,618
DATED : December 10, 1996
INVENTOR(S) : Takeuchi et al.

It is certified that error appears in the above-identified patent and that said Letters Patent is hereby corrected as shown below:

Col. 9, line 1, before "wherein" insert --further comprising: a first gear fixed at one end of said photosensitive drum and a second gear fixed at the other end of said photosensitive drum--.

Column 9, line 15, "coupliling" should be --coupling--.

Signed and Sealed this

Twentieth Day of May, 1997

*Attest:*

Bruce Lehman

BRUCE LEHMAN

*Attesting Officer*

*Commissioner of Patents and Trademarks*